United States Patent [19]

Krogstad

[11] Patent Number: 5,065,689

[45] Date of Patent: Nov. 19, 1991

[54] TURRET DEVICE

[75] Inventor: Ivar Krogstad, Arendal, Norway

[73] Assignee: Pusnes A/S, Norway

[21] Appl. No.: 473,961

[22] PCT Filed: Oct. 12, 1988

[86] PCT No.: PCT/NO88/00077

§ 371 Date: Apr. 12, 1990

§ 102(e) Date: Apr. 12, 1990

[87] PCT Pub. No.: WO89/03338

PCT Pub. Date: Apr. 20, 1989

[30] Foreign Application Priority Data

Oct. 12, 1987 [NO] Norway ..... 874246

[51] Int. Cl.[5] ..... B63B 21/50

[52] U.S. Cl. ..... 114/230; 441/5

[58] Field of Search ..... 441/3-5; 114/230; 141/279, 387, 388

[56] References Cited

U.S. PATENT DOCUMENTS

| | | | |
|---|---|---|---|
| 3,279,404 | 10/1966 | Richardson | 441/3 X |
| 3,335,690 | 8/1967 | Busking | 114/230 |
| 3,605,668 | 9/1971 | Morgan | 441/5 X |
| 4,478,586 | 10/1984 | Gentry et al. | 441/4 |
| 4,604,961 | 8/1986 | Ortloff et al. | 114/230 |
| 4,650,431 | 3/1987 | Kentosh | 441/4 X |
| 4,660,494 | 4/1987 | Doré et al. | 114/230 |
| 4,741,716 | 3/1988 | Hasebe et al. | 441/4 |
| 4,955,310 | 9/1990 | Pollack | 441/5 |

FOREIGN PATENT DOCUMENTS

| | | |
|---|---|---|
| 864496 | 5/1987 | Norway . |
| 2069966 | 9/1981 | United Kingdom . |
| 2094738 | 9/1982 | United Kingdom . |
| 2150517 | 7/1985 | United Kingdom . |
| 2166398 | 5/1986 | United Kingdom . |

*Primary Examiner*—Sherman Basinger

*Attorney, Agent, or Firm*—Andrus, Sceales, Starke & Sawall

[57] ABSTRACT

A turret device (12) which is anchored to the ocean floor, and a floating structure (1) which is supporting the turret device and can swing freely around it. The turret comprises a lower radial sliding bearing (4,5), with relatively small width and large diameter and an upper spherical axial bearing (2,3) with relatively small diameter. The rest of the turret can be disconnected from the upper spherical bearing (2,3) by a multiple thread, non-selflocking screw connection between a sleeve (35) and a hub (37), which in connected position are locked by a dog clutch (36). When disconnected, the turret will sink to a stable equilibrium a distance below the ocean surface. The turret device can be fitted forward of the bow of a ship (1), or between the bow and midship.

13 Claims, 2 Drawing Sheets

TURRET DEVICE

This invention relates to a turret device for connection to a floating structure such as a ship Turret devices for mooring of ships are known amongst others from U.S. Pat. Nos. 3191201 and 3279404. The drawbacks and deficiencies of known turret devices are mainly connected with their dimensions. These turrets are large and heavy, and this causes the manufacturing to be time consuming, difficult and expensive. Further, the large dimensions of the turret necessitate a correspondingly large well (cut-out) in the hull. This well can be difficult to arrange when modifying an existing ship, and under all circumstances the large cutout represented by the well must be structurally compensated by substantial reinforcements in the well area.

Hull deformations cause the bearing designs to be complicated.

If the vessel is to be disconnected from its anchor mooring lines, this must be done by disconnecting one anchor line at a time. Such operation is time consuming and can be critical in an emergency situation.

The above mentioned turret devices are positioned midship or in the forward half of the ship.

There are also smaller turret devices positioned in front of the ship's bow. The connection to the ship consists of a strong bearing housing which is transferring all the bearing forces. This bearing housing is positioned below the water surface. The structure which is supporting the bearing housing must be relatively strong because of the sea forces, which are largest in this part of the ship, and the bearing forces which are acting in all directions. Emergency release of the respective mooring lines is impossible because the lines are fixed to a plate below the bearing. Emergency release of the comparatively strong bearing arrangement below water is also practically impossible. Riser tubes are conducted through the center of the bearing and further through a tubular structure up to a fluid transferring swivel on level with the forecastle deck.

There is also a loading buoy, NO. 864496, which is clamped to the bow of a ship with two rigid clamps of several meters diameter, one upper and one lower. When releasing this buoy, the clamps must be detached and the loading buoy with its bearing arrangement is released from the ship.

The particular advantages obtained by this invention is a simple and light weight turret with a flexible bearing arrangement which is simple to install in the vessel, and a coupling mechanism which makes possible a simple engagement and release between the turret and the vessel. This invention comprises a turret arrangement with very limited dimensions. It is simple to release the anchor moored part of the turret in an emergency situation, or if the floating structure is to be temporarily moved for transportation of cargo, repairs or other reasons. The reconnection when the floating structure is returned is also simple.

The essential features of this design are the bearing arrangement and the coupling mechanism. A lower bearing which only takes horizontal forces, is fitted in the area where the horizontal component of the anchor mooring forces are acting. Thereby it is almost only axial forces which shall be transferred further to the upper bearing, where also the coupling mechanism is fitted.

However, the point of attack for the horizontal component of the anchor mooring line force will vary slightly if there are several mooring lines. When the horizontal component of the mooring line force deviates from the center of the lower bearing, there will be a moment. This moment is transferred as a bending moment in the structure, and it is resisted by a small horizontal force in the upper bearing.

The upper bearing is shaped like a spherical axial bearing. Thereby it can absorb large axial forces and moderate radial forces, at the same time as it will align itself in the direction of the center of the lower bearing. Such flexible alignment is important on floating structures, where deformation between the various parts of the hull easily occurs.

The upper bearing is made with relative small diameter, and in this way also the diameter of the coupling mechanism can be kept small. A small diameter gives small frictional bearing losses, at the same time as it simplifies the design of the coupling mechanism, and it provides ample clearance when the top of the turret is to pass the lower bearing. To obtain space for one or a few riser tubes in center of the bearing, the diameter of the bearing must be approximately 1 meter, but strength in the bearing and the coupling mechanism can permit a smaller diameter.

The coupling mechanism is in principle a multiple thread screw joint with a pitch large enough to cause unscrewing due to the axial force in the turret. The turret is not rotating in this situation and is moving vertically downwards with one coupling part, while the other coupling part is suspended in, and is rotating with, the upper bearing. In the engaged position the two coupling parts must be secured relative to each other to prevent relative rotation.

The lower bearing is made as a plain bearing with substantially larger diameter than the upper one, such that the structure above can pass through the bearing with ample clearance. A large diameter also gives the possibility of a narrow bearing for the same surface pressure. Small width bearings have less tendency for edge pressure when misaligned, and when the anchored part of the turret is to be released, the axial movement to clear the outer bearing surface is small. This is important by emergency release.

The turret arrangement will consist of three main parts:

1) The turret,
2) the upper spherical axial bearing with release mechanism and
3) the outer ring of the lower radial bearings with its attachments to the hull.

In the lower part of the turret there is a table or a bottom plate to which the anchor mooring lines are fixed. If there is only one line, it must be fixed in the center, and in that case it would be natural to replace the line with a torsional rigid tubular element which is connected by a cardan joint.

Normally, several anchor mooring lines of chain cable or steel wire rope are used.

The bottom plate is connected to the inner ring of the lower bearing through an intermediate structure. This inner ring must be very rigid to maintain its roundness when the bearing is strained. The inner ring can be compared to a wheel with a cylindrical external surface, preferably stainless. A tube is fixed to the center of the bottom plate and the lower bearing, and is extending further to the upper bearing.

It should be possible to lock the tube in several positions in order to maintain it fixed during inspection, maintenance or adjustment of the bearings and the anchor line attachment.

One or more riser pipes may be guided inside the tube and connected above the tube to a swivel with one or several paths.

The turret may be provided with buoyancy means where suitable with regard to adjacent structures. It is natural to consider the buoyancy means in connection with the anchor lines and their pretension in such a way that the turret maintains a stable vertical equilibrium below water when it is disconnected.

The upper bearing shall be looked upon as one unit, even though the inner ring is following the turret motions and the outer ring is following the vessel. A sleeve has an external collar which is suspended in the inner ring of the bearing. This sleeve can be supplied with internal threads like a nut, for connection to the turret, but a preferred embodiment is to extend the sleeve downwards below the bearing and provide the sleeve with external threads in the lower part of the extended portion. Thereby the exposed upper end of the vertical tube in the turret can be provided with internal threads which are very well protected against contact damage.

In the area between the bearing and the threaded portion the sleeve can be provided with axial splines for guidance of a dog clutch. The dogs may engage similar dogs in the top of the tubular turret, and thereby lock the turret against rotation relative to the sleeve.

Hydraulic jacks can press the dog clutch out of dog engagement if a sudden emergency situation should arise. Then the sleeve will rotate on the threads until the turret is free.

The threads are preferably coarse trapezoidal threads with large width. When the turret is to be engaged, this coupling procedure may be facilitated if the sleeve, which is suspended in the spherical bearing, can be oriented towards the center of the turret tube. Guide means can be fitted on the sleeve or on the turret tube, and by contact against the tube or the sleeve, the sleeve is oriented. When the first threads have contact with the opposite threads, the contact pressure can be used to align the sleeve in such a way that all the threads get contact.

Externally the upper bearing is supported in a bearing housing, which is resting in a bracket or the like, fixed to one of the upper decks or to the upper part of the vessel's bow.

The outer ring of the lower bearing can in principle be an elastic U-shaped strap surrounding the rigid inner ring, and with the two legs fitted to the hull in order to take the main load, which is longitudinal mooring load in direction aft. The mooring load will then be evenly distributed to the bight in the U, and further to the parallel legs and the hull.

However, there will also be side forces, and in some cases also longitudinal forces in direction forward. In order to take these loads, the outer ring must be complete and have a certain stiffness in one or two areas. For arrangement in the bow of a ship, it is natural to make the aft half of the outer ring rigid, while a natural arrangement in the bottom of a ship can require the whole ring rigid.

The outer ring can also be a polygon with a bearing element in each corner. This is a preferable embodiment because the area of the expensive self-lubricating bearing material can be limited, and good access to the bearing elements may be had.

On deck a winch is preferably arranged for hoisting the turret during connection and for lowering the turret during disconnection.

The same winch or one or two other winches can be used to tighten or slacken the anchor lines.

Figure 1:
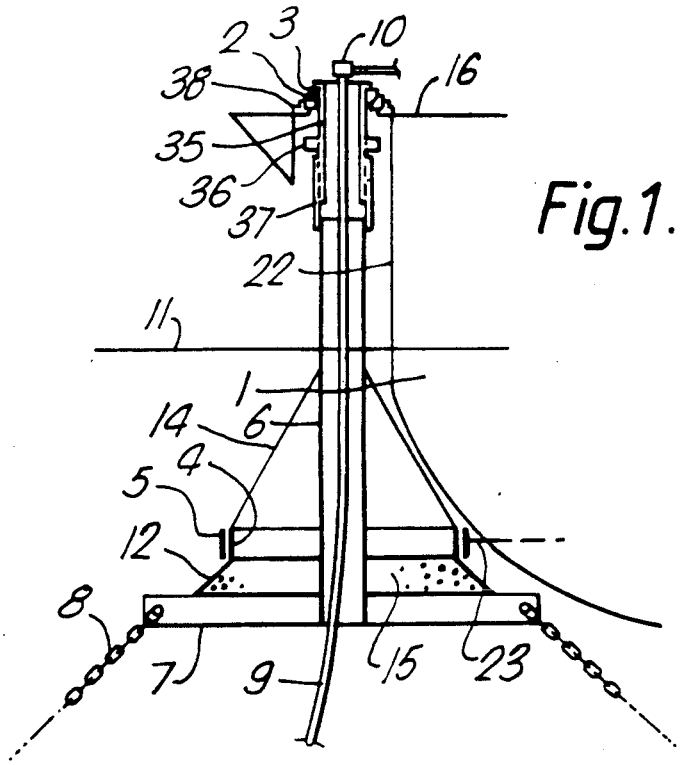
FIG. 1 is a side elevation view, partially in section, showing the turret device of the invention mounted forward of the bow of a ship.

The FIGS. 1–6 show examples of embodiments of the invention. The vessel can turn freely 360 degrees around the axis of a turret 12, which axis is vertical. The bearing arrangement of the vessel 1 and the turret 12 consists of an upper spherical thrust bearing 2,3 which mainly is carrying vertical loads, and a lower bearing 4,5 which only carries radial loads. The upper spherical bearings 2,3 and the attached coupling mechanism 31, 32 or 35, 36, have a relatively small diameter and are well protected above the sea surface 11.

The lower bearing 4,5 is preferably a self-lubricating sliding bearing which can operate submerged in sea water.

The lower bearing 4, 5 has a diameter of two to five times the average contact surface diameter of the upper bearing 2, 3.

The inner ring 3 in the upper bearing is through the coupling mechanism fixed to a tube 6, which is connected to the inner ring 4 in the lower bearing, and further to the bottom plate 7, which is moored to the ocean floor by a number of anchor lines 8.

The rotating part of the turret 12 further consists of a sleeve suspended in the inner ring 3 of the upper bearing and coupling the bearing to the tube 6, brackets 14, inner ring 4 in the lower bearing and the bottom plate 7. The turret 12 may also be equipped with buoyancy means 15, or closed spaces providing buoyancy. The purpose is fully or in part to compensate for the weight of the turret 12 and also the vertical component of the tension in the anchor lines 8. Thereby the turret 12 can obtain a stable equilibrium a distance below the surface 11 if it should be decided to uncouple the turret from the ship 1 for a period. In this case the connection between the sleeve for the inner ring 3 and the tube 6 must first be released. When the turret 12 is to be reconnected to the ship, the turret can be lifted by means of a line from a winch 29 through the bearing 2, 3.

One or more riser pipes 9 can pass through the tube 6, and the medium in the pipes can be transferred to or from the ship by means of swivels 10. One or two winches 30 on deck can be used to tighten or slacken the anchor lines 8.

FIG. 1 shows the turret 12 arranged in the bow of a ship 1. The outer ring 2 in the upper bearing rests in a bearing housing 38 on the deck 16 above a tubular shaft 22 surrounding a cutout in the flared bow. The sleeve 35 is suspended in the inner ring 3 of the spherical bearing and is engaged through a multiple thread connection with a hub 37, which is welded to the top of the tube 6. A dog clutch 36 can slide axially on the sleeve 35 and lock it for rotation relative to the hub 37. These details of the spherical bearing and the coupling mechanism are shown in more detail on FIG. 5. The horizontal plate 23 participates in the connection of the outer ring 5 to the hull 1. Inside the hull plating a plate is shown dotted in line with the plate 23. The brackets 14, which also may be a full cone, can guide the inner ring 4 into the outer ring 5 during connection of the turret 12.

Figure 2:
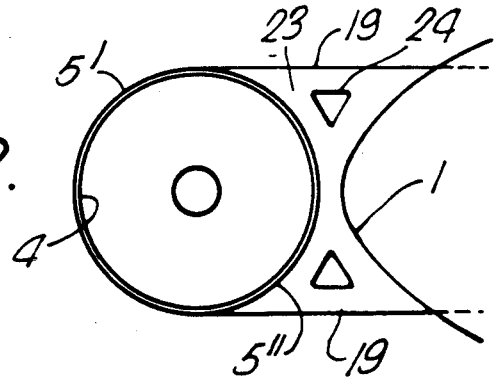
FIG. 2 is a partial top plan view showing one embodiment of the lower bearing assembly of the turret device of FIG. 1.

FIG. 2 shows a horizontal section at the lower bearing 4, 5. The inner ring 4 should be relatively rigid to maintain its roundness, while the outer ring 5 for large fore and aft loads acts as a tensioned band along the part of the periphery 5' which is forward relative to the ship 1. The tension in this band 5' is transferred directly into a tension stay 19, which transfers the tension into the hull of the ship 1, which in this area is very strong. If the tension stay 19 is penetrating the shell plating as shown in broken lines, the tension strain can be distributed to a large area.

The load in the band 5' is best equalized if it is flexible and can conform to the rigid surface 4, but there must of course be sufficient cross section area in the band to withstand the tension. The second part 5'' of the outer ring is not loaded by the main force, which is fore and aft forces pointing aft, but it is reasonable to stiffen it 5'' by means of the plate 23 to absorb the atwarthship forces which might occur.

Cutouts 24 in the plate 23 can be made to reduce the vertical wave forces during pitching of the ship 1.

Figure 3:
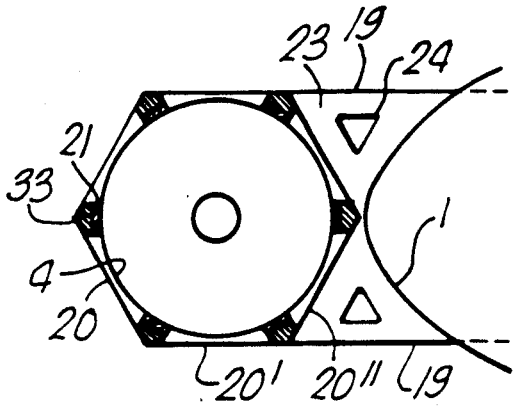
FIG. 3 is a view similar to FIG. 2, showing an alternate embodiment for the lower bearing arrangement.

FIG. 3 shows a preferred embodiment where the outer ring 20 in the lower bearing is made as a polygon. The drawing shows a hexagon, but to avoid large point loads against the inner ring 4, it is preferable to have more sides.

In each corner between two sides a bearing segment 21 is arranged. The radial force acting on the bearing segments is distributed as tension force in the two adjacent sides. The maximum fore and aft force transferred to the tension stay 19 will be the same as in FIG. 2. However, the design using a polygon is simpler because it does not require fine manufacturing tolerances. The band 5 must be rolled relatively round, while inaccuracies in the polygon 20 may be corrected at each bearing segment 21, for instance by the casting of plastic material 33 behind the bearing segments, by spacer plates behind each bearing segment, by individual adaption of steel brackets in the corners, or by a combination of any of these three methods.

The part of the band 20 in the extension of the tension stay 19, will have the same tension as the stay 19, as long as the total anchoring force is in the fore and aft direction. This part is designated 20'. The further course of the band 20 towards the bow of the ship is designated 20''.

Figure 4:
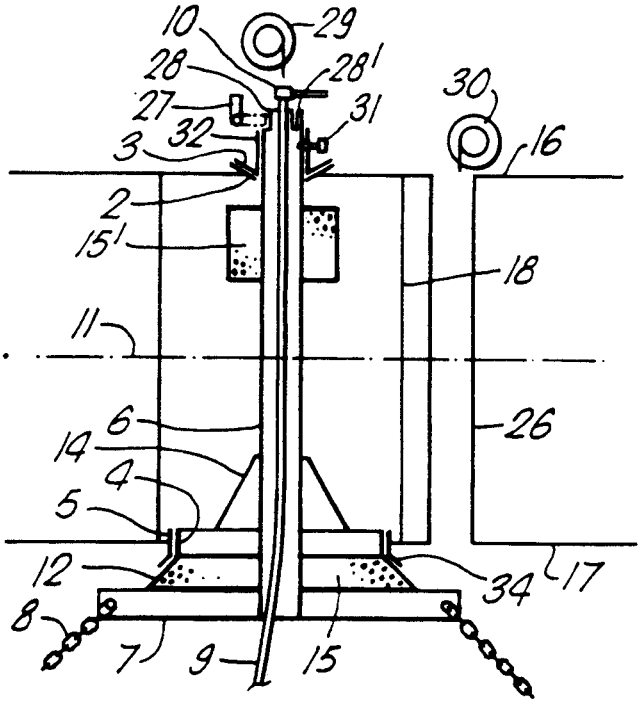
FIG. 4 is a side elevation view, partially in section, showing the turret device mounted to the ship between the bow and midship.

FIG. 4 shows an embodiment where the turret 12 is extending through the ship. The outer ring 2 of the upper bearing is fastened to a holding device (not shown) in connection with the deck 16. The bush 32 is here shown above the inner ring 2, and has a releasable connection 31 to the tube 6. The outer ring 5 in the lower bearing is connected to the bottom 17 of the ship. The outer ring can also in this proposal be a polygon 20. When the outer ring is built into the hull as shown, it is natural that the periphery acts as a flange to reinforce the cutout in the bottom 17. However, it is obviously also possible to arrange a separate reinforcement of the hull and suspend the outer ring 5, 20 in several tension bands extending in different directions.

Water will leak through the bearing 4, 5 in the bottom, and bulkhead 18 between the bottom 17 and deck 16 must therefore be arranged to prevent the leakage from proceding.

A vertical watertight shaft 26 can give access for inspection one by one of the terminations for the anchor lines 8. In such cases the turret 12 is locked against rotation relative to the ship 1. The winch 30 can be used to adjust the tension in the anchor lines 8 through guiding of an ancillary line through the shaft 26.

A guiding plate 34 is centering the inner ring 4 when it is to be guided from below into the outer ring 5. A pawl device 27 which is fixed to the deck 16, can pivot downwards into one of several notches 28, 28' in the tube 6 to lock the turret 12 against rotation. The pawl 27 is shown in broken lines positioned in one of the notches 28.

Figure 5:
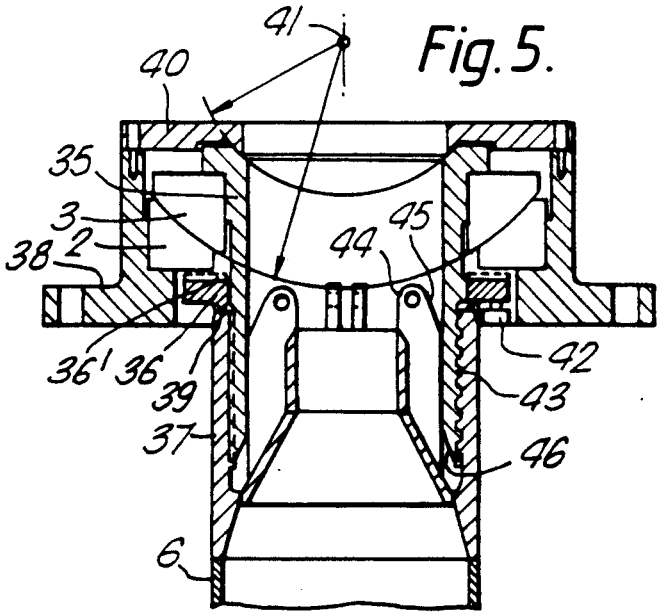
FIG. 5 is a detailed partial vertical sectional view through the upper bearing assembly of the turret device of FIGS. 1 and 4.

FIG. 5 shows details of the spherical bearing and of the coupling mechanism on FIG. 1. The center 41 of the spherical bearing 2,3 is shown. Between the sleeve 35 and the cover 40 a spherical surface is shown with the same center 41. Actually, there is a narrow gap where this spherical surface is shown, but if, in an extreme situation, lift should occur on the turret 12, the cover 40 will counteract at this spherical surface. The bearing housing 38 shall be bolted to a reinforcement of the deck 16, not shown. The locking mechanism to prevent rotation of the turret during maintenance works etc. shown in principle by the pawl 27 and notches 28 on FIG. 4, can simply be arranged by bolts between the cover 40 and the sleeve 35 in this Figure.

The sleeve 35 externally has several buttress threads 43, having so large a pitch that the threaded joint is not selflocking. The shape of the threads are only shown in section on the right side, while the threads in the section on the left side are shown dotted. The opposite hub 37 has internal buttress threads, which are shown in matching contact with the threads 43. There are eight to 16 threads between sleeve 35 and hub 37. A dog clutch 36 can slide on axial splines on the outside of the sleeve 35. One 39 of several dogs are shown in engaged position against a matching dog on the hub 37, which is thereby prevented from rotation relative to the sleeve 35. The dotted contour 36' shows the upper disengaged position of the clutch 36, when it is lifted by means of the jack 42 or the hub 37.

Lifting lugs 44 are connected to the hub 37. On the outside of these lifting lugs are guiding edges 45 which during entering will guide against a conical guiding surface 46 on the inside of the sleeve 35 and provide orientation towards the hub 37.

Figure 6:
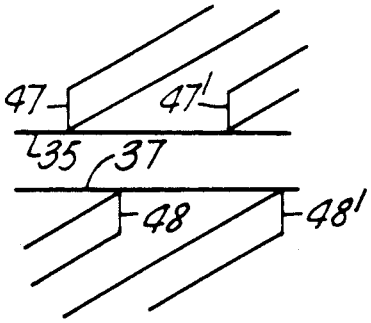
FIG. 6 is a displayed section view showing a portion of the upper bearing assembly of FIG. 5.

FIG. 6 shows a displayed cylinder section of an area near the lower end surface of sleeve 35 and the upper end surface for the hub 37, and how the ends of the threads in this area can be shaped 47, 47', 48, 48' to secure engagement in all relative angles of rotation.

The procedure for connection of the turret device will then be as follows.

A line is led from the winch 29 through the upper spherical bearing 2,3 and further through the outer ring 5 in the lower bearing, and fastened to the top of the tube 6. The line must pull approximately in center of the tube, and this can be achieved for instance by connecting the line to two or more equal long rope slings, which are fastened to lifting lugs 44 arranged symmetrically inside the tube 6.

The turret 12 is lifted form its subsurface position until the hub 37 on the tube 6 passes the outer ring in the lower bearing, and further until the hub 37 is in position for entering the sleeve 35. If the hoisting line is passing approximately through the center of the upper bearing, the conical guiding surface 46 of the sleeve 35 will be guided by edges 45 of the hub 37 when it is lifted further. The sleeve 35 then deflects in the spherical bearing. When the guiding edges 45 have passed the conical guiding surface 46, the first threads of the sleeve 35 and the hub 37 can be in contact. The contact pressure will cause the sleeve 35 to deflect until it is axial with the hub 37, and all the threads will then be in contact.

Further hoisting of the hub 37 causes the sleeve 35 to rotate. During the last part of the rotation, the hub 37 will push the dog clutch 36, but when the dog clutch reaches the dotted position 36', the dogs 39 enter the zone for engagement with the hub 37, and the dog clutch 36 is falling by gravity to the position shown. The dogs 39 will then prevent further rotation of the sleeve 35 in both directions.

Simultaneously with the entering of the coupling at the upper spherical bearing, the cone 14 has guided the inner ring 4 of the lower bearing into the outer ring 5.

Thereafter the tension in one by one or two and two of the anchor lines 8 can be adjusted by means of one or two winches 30. Before this operation, the ship must be turned by means of tugs or its own propeller equipment, and the turret locked by means of the pawl 27 or the like in the correct position. It is also possible to do a complete tensioning of all anchor lines in this way if the anchors are deployed by another ship.

A line which in advance is led through the tube 6 and fastened to an easily accessible spot on the bottom plate 7, is loosened from the bottom plate and connected to the riser pipe 9. Thereafter the riser pipe is hoisted by means of the winch 29 and connected to the ship's pipe system through the swivel 10. When a flexible riser pipe is used, it is also possible to have it attached inside the tube 6.

When disconnecting the turret, this can be done according to two procedures, either by controlled lowering by means of the winch 29, or as a free drop where the water resistance is the brake. Solutions adopting part solutions from both the described procedures can also be used.

By controlled lowering of the turret, the riser pipe 9 is first disconnected from the swivel 10 and lowered by the winch 29, and marked with a small buoy. The marking buoy can for instance be connected to the bottom plate 7 and have a line connection through the pipe 6.

Thereafter a line from the winch 29 is fixed to the turret, and the winch is hoisting until it holds the vertical force from the turret 12. Jacks 42 can then lift the dog clutch 36, and the turret is lowered until it has found its natural position of equilibrium below water. The line is disconnected from the winch and connected to a marking buoy with an ancillary line. The marking buoy can for instance be placed on deck and connected to an ancillary line led downwards along the ship side and further between the polygon outer ring 20, a bearing segment 21, 33 and the inner ring 4 to an area near deck where it can easily be reached.

By the second procedure, the riser pipe 9 may for instance be fixed to the tube 6, so that it can simply be disconnected from the swivel 10. Marking buoy with line can be prepared in advance on the turret. By activation of the hydraulic jacks 42 the dog clutch 36 is pressed out, and the turret is dropping under the action of gravity and the vertical force from the anchor lines, but braked by the water resistance and the buoyancy until it finds its natural equilibrium.

I claim:

1. A turret device adapted to be anchored to the ocean floor, and a floating structure for supporting the turret device in an upper axial bearing and a lower radial bearing to allow the floating structure to turn freely around the turret device, characterized in that the upper bearing is a self-aligning spherical bearing (2, 3) in direct contact between the floating structure and the turret device, wherein the upper spherical bearing includes first and second bearing members each having curved mating bearing surfaces, the bearing surfaces being in engagement with each other and movable relative to each other, wherein the first bearing member is non-rotatably fixed to the floating structure and the second bearing member is fixed to the turret device.

2. A turret device according to claim 1, characterized in that a sleeve (35) is connected to one of the bearng members (2, 3), wherein the sleeve (35) has a non-selflocking multiple thread connection to a hub (37), and further comprising a dog clutch (36) axially movable on the sleeve (35) and having dogs (39) which can engage corresponding dogs in the hub (37) and thereby lock the sleeve (35) and the hub (37) against relative rotation.

3. A turret device according to claim 2, characterized in that the second bearing member comprises an inner ring and the first bearing member comprises an outer ring, wherein the sleeve (35) is suspended in the inner ring (3) and has external threads (43) toward its lower end and wherein the dog clutch (36) is located above the external threads, and wherein the hub (37) has internal threads for mating with the external threads.

4. A turret device according to claim 3, characterized in that one of the sets of mating threads (43) are trapezoidal and have pointed end surfaces (47, 48), for engaging the other of the sets of threads when the sleeve and hub are connected.

5. A turret device according to claim 4, characterized in that the number of threads (43) is eight to sixteen.

6. A turret device according to claim 3, characterized in that the lower bearing (4, 5) has a diameter of two to five times the diameter of the upper bearing (2, 3).

7. A turret device according to claim 6, characterized in that the lower bearing includes an outer bearing ring in the shape of a polygon (20), and further comprising a sliding bearing segment arranged in each corner of the outer ring between two edges thereof.

8. A turret device according to claim 6, characterized in that the lower bearing includes an outer bearing band engaged with an inner bearing member, and wherein the outer bearing band is flexible so as to conform to the inner bearing member.

9. A turret device according to claim 1, characterized in that the turret device is arranged forward of the bow of a ship (1).

10. A turret device according to claim 1, characterized in that the turret device is arranged in the centerline of a ship between the bow and midship.

11. A turret device according to claim 1, characterized in that the turret device is provided with buoyancy means (15, 15') such that when the turret device is disconnected from the upper bearing, it can take up a vertical equilibrium position a distance below the ocean level.

12. A turret device adapted to be anchored to the ocean floor and which is adapted to be mounted to a floating structure, comprising:

a longitudinally extending turret member;

a lower bearing interposed between the floating structure and the turret member and in direct contact with the floating structure and the turret member; and an upper spherical bearing interposed between the floating structure and the turret member, the upper spherical bearing including first and second bearing members each having curved mating bearing surfaces, said bearing surfaces being in engagement with each other and movable relatve to each other to accommodate deflection of the turret member from its longitudinal axis, wherein said first bearing member is non-rotatably fixed to said floating structure and said second bearing member is fixed to said turret member.

13. A method of connecting a turret device to a floating structure, the turret device including a hub (37) toward its upper end having threads, comprising the steps of:

mounting a spherical bearing assembly (2, 3) to the floating structure, the spherical bearing assembly including a sleeve (35) having threads (43);

providing a conical guiding surface (46) on the sleeve (35);

mounting a dog clutch (36) to the sleeve, the dog clutch being movable afrom a disengaged position to an engaged position;

leading a hoisting line through the spherical bearing assembly (2, 3) and fixing the hoisting line to the hub (37) of the turret device;

hoisting the hoisting line relatively fast until the hub (37) approaches the sleeve (35) and is positioned to enter the sleeve (35) by engagement of the hub (37) with the conical guiding surface (46) on the sleeve (35), whereby any misalignment between the sleeve (35) and the hub (37) is accommodated by the spherical bearing assembly (2, 3);

hoisting the hub (37) relatively slowly until the sleeve threads (43) and the hub threads contact, resulting in contact pressure between the two sets of threads, wherein the sleeve (35) causes movement of the spherical bearing assembly (2, 3) to align the sleeve (35) with the hub (37);

further hoisting the hub (37) to cause rotation of the sleeve (35) in the bearing assembly (2, 3) until the hub engages the dog clutch (36) and causes the dg cluch to attain its engaged position to prevent further rotation of the sleeve; and lowering the hub (37), whereby rotation of the sleeve (35) is prevented by the dog clutch (36), and the vertical load of the turret device is carried by the threaded connection between the sleeve (35) and the hub (37).

* * * * *

UNITED STATES PATENT AND TRADEMARK OFFICE

CERTIFICATE OF CORRECTION

PATENT NO. : 5,065,689

DATED : November 19, 1991

INVENTOR(S) : Ivar Krogstad

It is certified that error appears in the above-identified patent and that said Letters Patent is hereby corrected as shown below:

On the Title page, item [56]
Delete "2,069,966" and substitute therefor
-- 2,069,955 --.

IN THE CLAIMS

Claim 1, Col. 8, Line 16:
After "(2,3)", insert -- and the lower bearing is a plain bearing (4,5) --;

Claim 2, Col. 8, Line 26:
Delete "bearng" and substitute therefor
-- bearing --;

Claim 12, Col. 9, Line 19:
Delete "relatve" and substitute therefor
-- relative --; and Claim 13, Col. 10, Line 24:
Delete "dg" and substitute therefor -- dog --.

Signed and Sealed this

Sixth Day of April, 1993

*Attest:*

STEPHEN G. KUNIN

*Attesting Officer*

*Acting Commissioner of Patents and Trademarks*